US012421632B2

(12) United States Patent
Schmolke et al.

(10) Patent No.: US 12,421,632 B2
(45) Date of Patent: Sep. 23, 2025

(54) ELASTIC CLEANING LIP, SUPPORT ELEMENT, AND CLEANING UNIT

(71) Applicant: Maschinenfabrik Rieter AG, Winterthur (CH)

(72) Inventors: Daniel Schmolke, Ingolstadt (DE); Dietmar Greis, Ingolstadt (DE)

(73) Assignee: Maschinenfabrik Rieter AG, Winterthur (CH)

( * ) Notice: Subject to any disclaimer, the term of this patent is extended or adjusted under 35 U.S.C. 154(b) by 164 days.

(21) Appl. No.: 17/539,450

(22) Filed: Dec. 1, 2021

(65) Prior Publication Data

US 2022/0170184 A1 Jun. 2, 2022

(30) Foreign Application Priority Data

Dec. 2, 2020 (DE) ..... 10 2020 132 058.2

(51) Int. Cl.
*D01H 5/62* (2006.01)

(52) U.S. Cl.
CPC ..... *D01H 5/62* (2013.01)

(58) Field of Classification Search
CPC ..... D01H 5/62; D01H 5/625; D01H 5/64; D01H 5/645; D01H 5/66; D01H 5/68
USPC ..... 198/497
See application file for complete search history.

(56) References Cited

U.S. PATENT DOCUMENTS 2,964,806 A * 12/1960 Naegeli ..... D01H 5/62 15/256.51
4,406,039 A * 9/1983 Hotz ..... D01H 5/62 15/256.51
4,586,212 A * 5/1986 Gasser ..... D01H 5/62 15/256.51
4,819,302 A * 4/1989 Fukuda ..... D01H 5/62 19/264

(Continued)

FOREIGN PATENT DOCUMENTS

DE 196 42 198 A1 4/1998
DE 102 07 255 A1 9/2003

(Continued)

OTHER PUBLICATIONS

German Patent Office Search Report, Oct. 6, 2021.

(Continued)

*Primary Examiner* — Uyen T Nguyen
(74) *Attorney, Agent, or Firm* — Dority & Manning, P.A.

(57) ABSTRACT

An elastic cleaning lip for cleaning a rotating roller of a drafting system of a textile machine includes a wiping edge configured at one longitudinal side of the cleaning lip. A mounting element is at an opposite longitudinal side of the cleaning lip and is configured to mount to a support element. The cleaning lip has a Y-shaped cross section having a stem and two essentially parallel legs, wherein the wiping edge is arranged at an end of the stem and the two legs form the mounting element for a form-locking mounting of the cleaning lip to the support element. The support element includes retainers at opposite longitudinal ends thereof and a mount- (Continued)

ing strip having lateral faces and top and bottom end faces arranged between the retainers. The lateral faces and the top end face are configured for the form-locking mounting with the cleaning lip.

13 Claims, 4 Drawing Sheets

(56) References Cited

U.S. PATENT DOCUMENTS

| | | | | |
|---|---|---|---|---|
| 5,865,294 | A * | 2/1999 | Betz | B65G 45/12 198/497 |
| 5,940,925 | A * | 8/1999 | Gohler | D01H 5/62 19/264 |
| 5,956,811 | A * | 9/1999 | Cahannes | D01G 15/24 474/205 |
| 6,401,308 | B1 * | 6/2002 | Kawahara | A44B 17/0058 24/584.1 |
| 7,367,443 | B2 * | 5/2008 | Swinderman | B65G 45/16 198/497 |
| 2003/0046829 | A1 * | 3/2003 | Baechtold | A43B 5/0421 36/15 |
| 2003/0066737 | A1 * | 4/2003 | Malmberg | B65G 45/12 198/497 |
| 2005/0121294 | A1 * | 6/2005 | Finger | B65G 45/16 198/497 |
| 2006/0108200 | A1 * | 5/2006 | Peterson | B65G 45/16 198/497 |
| 2006/0108202 | A1 | 5/2006 | Swinderman | |
| 2006/0225990 | A1 * | 10/2006 | Yoshizako | B65G 45/12 198/499 |
| 2011/0192705 | A1 * | 8/2011 | Kotze | B65G 45/12 198/497 |
| 2012/0160634 | A1 * | 6/2012 | Zieger | B65G 45/12 198/497 |

FOREIGN PATENT DOCUMENTS

| | | |
|---|---|---|
| EP | 0 045 725 A1 | 2/1982 |
| EP | 1 434 725 B1 | 3/2008 |
| KR | 101 694 835 | 1/2017 |
| WO | 01/70604 | 9/2001 |

OTHER PUBLICATIONS

EPO Search Report, Apr. 26, 2022.
European Office Action for corresponding Application No. EP 21 211 542.2, dated Mar. 13, 2024, 6 pages.

* cited by examiner

ELASTIC CLEANING LIP, SUPPORT ELEMENT, AND CLEANING UNIT

FIELD OF THE INVENTION

The present invention relates to an elastic cleaning lip for cleaning a rotating roller of a drafting system of a textile machine, wherein the cleaning lip includes a wiping edge at one of its longitudinal sides, and, at its other longitudinal side, a mounting element for mounting at a support element, and a support element for supporting an elastic cleaning lip, wherein the support element has retainers at the front ends and a mounting strip having lateral faces and end faces is arranged between the retainers, and an appropriate cleaning unit.

BACKGROUND

DE 102 07 255 A1 describes a textile machine having a drafting system including multiple rollers for drafting a sliver, which includes at least one cleaning lip arranged along a roller for cleaning the outer surface of the roller of textile fiber material and means for generating an air flow for carrying away this fiber material. The cleaning lip is essentially made up of a support means and an elastic lip made of plastic. The support means can be, for example, a bar, a tube, or a flat strip. The lip is form-lockingly mounted on the support means in an injection molding process. It is disadvantageous that, when the lip becomes worn, both the support means as well as the lip must be replaced, since they cannot be separated from one another.

EP 0 045 725 A1 describes a detachable connection of a cleaning strip having a bar. A root portion engages into an appropriate groove having a complementary cross section, which is formed in the bar 15. In this way, the cleaning strip can be pushed out of the groove in the longitudinal direction of the bar, and so it can be replaced at the end of its service life. The fixation of the cleaning strip in the longitudinal direction of the bar can be problematic, however. In addition, a large amount of space is required laterally with respect to the bar in order to be able to pull the cleaning strip out of the bar.

SUMMARY

A problem addressed by the present invention is that of eliminating the disadvantages known from the prior art and creating a cleaning unit for cleaning a rotating roller of a drafting system of a textile machine, including a support element and a cleaning lip arranged thereon, in the case of which a secure mounting of a cleaning lip and a simple replacement of a worn cleaning lip are possible.

Additional objects and advantages of the invention will be set forth in part in the following description, or may be obvious from the description, or may be learned through practice of the invention.

The objects are achieved by a cleaning lip, a support element, and a cleaning unit having the features set forth herein.

The invention provides an elastic cleaning lip for cleaning a rotating roller of a drafting system of a textile machine, wherein the cleaning lip has a wiping edge at one of its longitudinal sides and, at its other longitudinal side, a mounting element for mounting at a support element. According to the invention, the cleaning lip is designed Y-shaped in cross section, having a stem and two essentially parallel legs, wherein the wiping edge is arranged at the open end of the stem and the two legs form the mounting element for a form-locking mounting of the cleaning lip at the support element. The cleaning lip is therefore capable of encompassing the support element, which is located between the two legs. It can be slipped onto the support element, is securely mounted there for the duration of its use for cleaning the roller and, after it has become worn, can be easily removed by pulling it off the support element. A new cleaning lip is then mounted on the support element. As a result, the support element can be reused. This saves resources and is more cost-effective. Due to the bilateral encompassing of the support element, a stable mounting of the cleaning lip on the support element is made possible. In addition, the installation and removal of the cleaning lip on/from the support element is possible perpendicular to the longitudinal extension of the support element and/or the cleaning lip. The support element therefore does not necessarily need to be removed from the textile machine in order to be able to replace the cleaning lip.

It is also advantageous when the legs are connected to each other by at least one web, preferably a plurality of webs. The webs stabilize the legs, and so the legs cannot be bent up if a transverse force is applied onto the cleaning lip. The webs therefore reinforce the cleaning lip and, thereby, additionally ensure the possibility of securely mounting the cleaning lip on the support element.

It is advantageous when the web, as viewed from the open end of the legs, has at least one undercut. The leg can be designed, for example, in the shape of a strip, a wedge, a trapezoid, or a drop. Due to the undercut, a force can be generated, which prevents an unintentional removal of the cleaning lip from the support element. The undercut can be overcome in order to mount the cleaning lip on the support element, in particular when the cleaning lip and/or the support element are/is designed to be elastic.

It is advantageous when the web is slanted with respect to the longitudinal side of the cleaning lip at an obtuse angle, in particular an angle between 60° and 85°. The above-described undercut of the web is, due to such an inclination of the web with respect to the longitudinal side of the cleaning lip, a very good compromise between a retention force, which holds the cleaning lip at the support element, and the possibility that the undercut can be overcome due to the elasticity of the cleaning lip or of the support element.

It is also advantageous when adjacent webs are slanted in a diametrically opposed manner with respect to one another. As a result, it is ensured that a secure mounting of the cleaning lip at the support element is also ensured in the case of a transverse force that is directed obliquely with respect to the longitudinal direction of the cleaning lip, since webs are always present, which are greatly tilted counter to the arising, oblique transverse force and counteract the removal of the cleaning lip from the support element.

It is also advantageous when the cleaning lip has a groove at the stem, which extends in its longitudinal direction and, when the cleaning lip is utilized as intended in the textile machine, extends horizontally and in parallel to the rollers. Due to this groove extending in the longitudinal direction of the cleaning lip, the cleaning lip can be more easily bent in the direction in which the groove is located than in the other direction. This is advantageous, in particular, during use for cleaning a roller, since the cleaning lip can better rest against the roller and very well remove fiber residues or dust therefrom.

It is also advantageous when the cleaning lip has at least one groove extending transversely to its longitudinal direction. The groove extending transversely to the longitudinal direction of the cleaning lip can act as a marking. In particular when different lengths of the cleaning lip are required, this groove can represent a sign that indicates where the cleaning lip is to be trimmed for the further required length. In this way, it is possible that the cleaning lip is delivered with a longer length, which is intended, for example, for the bottom rollers of a drafting system. As necessary, when the cleaning lip must be used, for example, for the top rollers of a drafting system, and a shorter length of the cleaning lip is necessary there, the cleaning lip can be shortened at the marking and, thereby, also utilized for the top rollers of the drafting system. In addition, it is possible that the cleaning lip is delivered to the customers as so-called yard goods. Due to the regularly arranged markings at this very long cleaning lip, the cleaning lip can be shortened to the correct length.

A support element according to the invention for supporting an above-described elastic cleaning lip has retainers at its front ends. The retainers are utilized for ensuring that the support element and, thereby, the cleaning lip can be correctly positioned and mounted in the drafting system in order to contact the roller to be cleaned with the intended pressure and an intended position with respect to the roller. A mounting strip having lateral faces and end faces is arranged between the retainers of the support element. According to the invention, the lateral faces and at least one of the end faces of the support element are provided for the form-locking mounting of the cleaning lip. As described above, the cleaning lip encompasses the support element and, as a result, is mounted at the support element. The cleaning lip is therefore seated at an end face of the support element extending along the support element and contacts the two lateral faces in order to rest against these. As a result, the support element enables a reliable mounting of the cleaning lip at the support element. Due to the possibility of resting against the support element also counter to transverse forces, which are directed transversely to the longitudinal direction of the support element and/or the cleaning lip, a sufficient force can be applied onto the roller to be cleaned.

It is also advantageous when the mounting strip has at least one recess at the end face, preferably a plurality of recesses for accommodating at least one web of the cleaning lip. Due to the recess or recesses in the mounting strip, not only is it made possible for the cleaning lip to rest against the support element transversely to its longitudinal direction, but rather, forces acting in the longitudinal direction of the cleaning lip can also be counteracted as a result. The position of the recesses corresponds to the webs of the cleaning lip, which is provided for mounting on the support element.

Moreover, it is advantageous when the recess is slanted with respect to the end face at an obtuse angle, in particular an angle between 60° and 85°. Due to the inclination of the recesses, an even better interlocking of the cleaning lip with its webs at the mounting strip of the support element is possible. Forces that act on the cleaning lip not only in the longitudinal direction or transversely to the longitudinal direction can also be absorbed as a result. In addition, due to this inclination of the recesses, forces that act obliquely on the cleaning lip can also be particularly effectively counteracted.

It is also advantageous when adjacent recesses are slanted in a diametrically opposed manner with respect to one another. Due to this diametrically opposed inclination of the recesses, in which the webs of the cleaning lip can interlock, a particularly secure accommodation of the cleaning lip at the support element is enabled. The slanted recesses reliably prevent an unintended separation of the connection between the cleaning lip and the support element during the operation of the cleaning lip, even though forces act upon the cleaning lip from highly diverse directions.

It is also advantageous when the support element is made of plastic or of metal. It is essential that the support element forms a sufficient resistance, so that the cleaning lip can securely and uniformly press against the roller to be cleaned.

A cleaning unit according to the invention for cleaning a rotating roller of a drafting system of a textile machine includes a support element and a cleaning lip arranged thereon, which are designed in the manner described above.

The cleaning lip is used for cleaning the top rollers and/or the bottom rollers of a drafting system. The purpose of the new development is, in particular, that the metal part supporting the cleaning lip does not need to be discarded when the cleaning lip becomes worn.

The new cleaning lip encompasses the metal support with lateral legs. The lateral legs are preferably connected to each other with webs and/or ribs. These webs and/or ribs engage into recesses of the metal support. The webs and/or ribs ensure, on the one hand, that the lateral legs are stable. On the other hand, they ensure a particularly good mounting of the cleaning lip at the metal support when the webs and/or ribs are arranged, not rectangularly, but rather obliquely and slanted with respect to the top edge of the cleaning lip. Due to this inclination, a form fit of the webs with respect to the metal support arises (in the manner of a zipper). The inclination is preferably designed in the form of multiple web pairs arranged in the shape of a V with respect to one another, i.e., diametrically opposed.

Since the cleaning lip must have a different length for the top roller and for the bottom roller, the cleaning lip is advantageously designed as a longer version, wherein a notch or a groove can be arranged at the cleaning lip itself and/or at the lateral leg to mark the shorter length. In principle, the cleaning lip could also be manufactured to be endless and trimmed by the customer according to demand.

In order to identify the front side and the back side of the cleaning lip, markings, for example, the section marks or also part numbers, are provided on only one side.

The material of the elastic cleaning lip is preferably polyurethane or hydrogenated nitrile butadiene rubber (HNBR) or silicone.

The device is designed according to the preceding description, wherein the mentioned features can be present individually or in any combination.

BRIEF DESCRIPTION OF THE DRAWINGS

Further advantages of the invention are described in the following exemplary embodiments, wherein.

DETAILED DESCRIPTION

Figure 1:
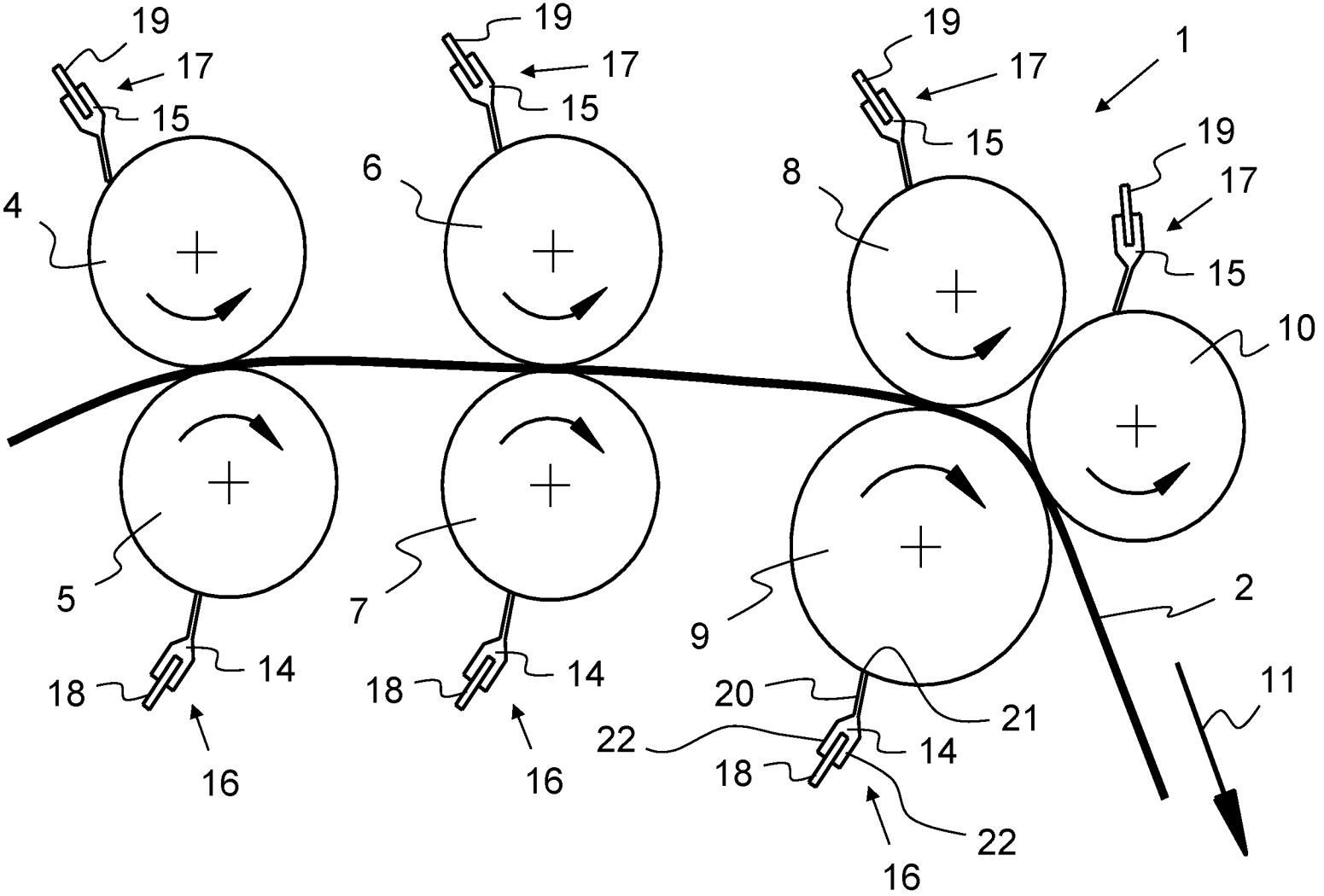
FIG. 1 shows a schematically represented drafting system in a side view.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

In the following description of the alternative exemplary embodiments represented in the figures, the same reference numbers are utilized for features that are identical and/or at least comparable to the previously described exemplary embodiments in terms of their design and/or mode of operation. Provided the features are not described in detail again, their design and/or mode of operation correspond/corresponds to the design and mode of operation of the above-described features. For the sake of clarity, not all identical parts are provided with reference numbers, although they are identically drawn.

FIG. 1 schematically shows three roller pairs of a drafting system 1, namely the input roller pair 4, 5, the middle roller pair 6, 7, and the output or delivery-roller pair 8, 9. Additionally, a top deflection roller 10 is arranged at the output of the drafting system 1. The directions of rotation of the individual rollers are represented by arrows. The top rollers 4, 6, 8, 10 each have an elastic roller cot. A sliver or slivers 2 is/are drafted in the running direction 11 in the drafting system 1, in that the consecutive roller pairs 4-10 rotate at an increasing circumferential speed.

Moreover, cleaning lips 14 are present for cleaning the metallic bottom rollers 5, 7, 9, which rest against the particular outer surface of the roller under bending stress and, on the one hand, scrape off fiber and trash material from the outer surface of the roller and, on the other hand, allow a portion of the fibers and also trash to pass through, with deceleration. The portion of the material transported through essentially loses its static friction with the particular bottom roller 5, 7, 9 and can drop downward. An air flow carries away the scraped-off material as well as the material conveyed through, under the cleaning lip, in a downward direction. Further cleaning lips 15 are provided for cleaning the top rollers 4, 6, 8, and 10. These cleaning lips 15 are generally shorter than the cleaning lips 14, since the top rollers 4, 6, 8, and 10 are shorter than the bottom rollers 5, 7, 9.

The cleaning lips 14 and 15 are part of a cleaning unit 16 and 17, respectively, which are identically designed, in principle. Each cleaning unit 16 and 17 includes a support element 18 and 19, respectively, and a cleaning lip 14 and 15, respectively, arranged thereon. One difference is merely that the cleaning lips 14 for the bottom rollers 5, 7, 9 are longer than the cleaning lips 15 for the top rollers 4, 6, 8, and 10. A corresponding length difference can also be provided in the support elements 18 and 19. This is due to the design of the bottom rollers 5, 7, 9, which are longer metal cylinders and the design of the top rollers 4, 6, 8, and 10, which are shorter rollers coated with a rubber coating.

Moreover, the cleaning units 16 and 17 are arranged essentially in parallel to the roller longitudinal axis of the bottom rollers 5, 7, 9 and of the top rollers 4, 6, 8, and 10. It is clear from FIG. 1 that the cleaning lips 14 and 15 are arranged more or less offset in the sliver-running direction with respect to the vertical plane extending through a roller longitudinal axis. As a result, a defined inclination of the elastic portion of the cleaning lip 14, 15 with respect to the roller 4-10 is ensured.

Each of the cleaning units 16 and 17 includes essentially one support element 18 and 19, respectively, and one elastic cleaning lip 14 and 15, respectively. The support element 18 and 19 can be, for example, a bar, a tube, or a flat strip. The elastic cleaning lip 14 and 15 is form-lockingly mounted on the support element 18 and 19, as described in greater detail in the following.

Each cleaning lip 14 and 15 is designed in the shape of a Y. A wiping edge 21 is arranged at the end of a stem 20. The wiping edge 21 contacts the particular roller 4-10 and drags on its surface when the particular roller 4-10 rotates. In the process, the surface of the particular roller 4-10 is cleaned. The Y of the cleaning lip 14 or 15 has, following the end of the stem 20 facing away from the wiping edge 21, two legs 22, which are aligned essentially in parallel to one another. The two legs 22 encompass the support element 18 and 19, thereby ensuring a fixed, form-locking connection between the cleaning lip 14 and 15 and the support element 18 and 19, respectively.

Figure 2:
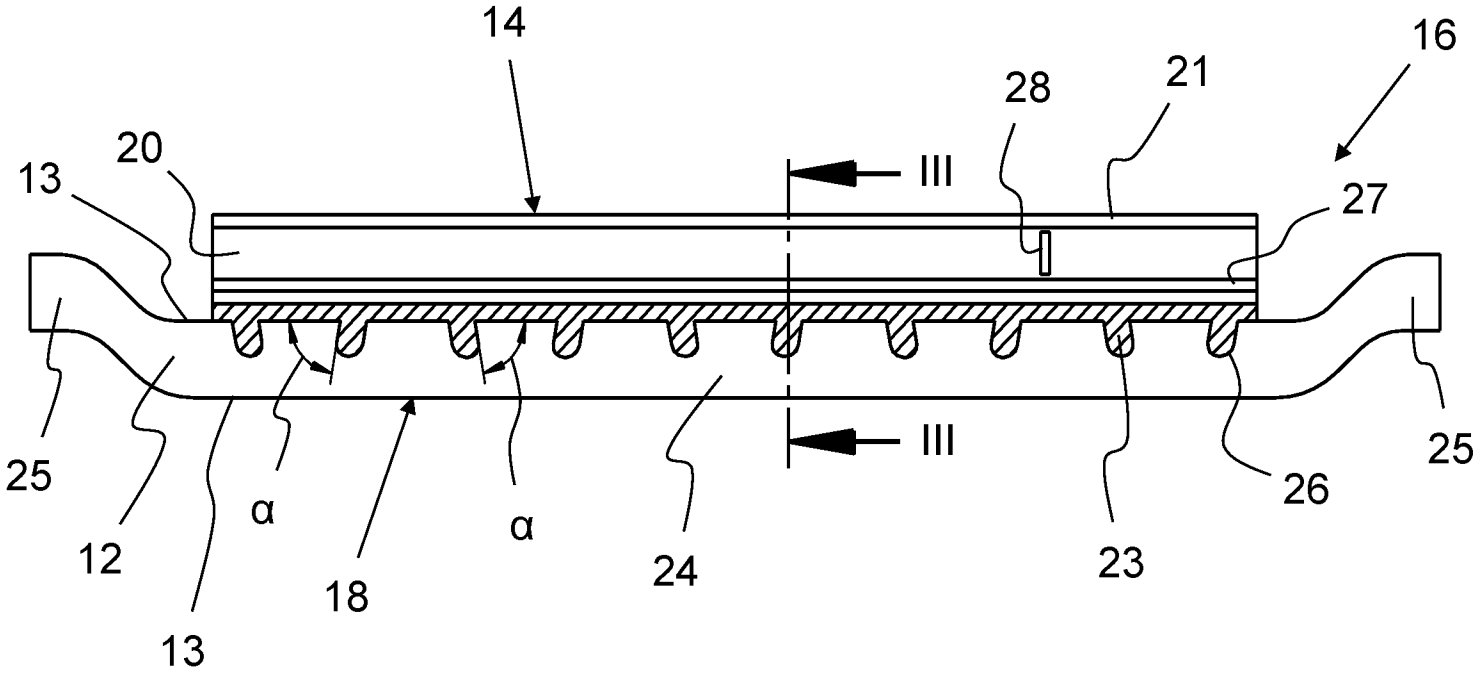
FIG. 2 shows a side view of a cleaning unit having a support element and a cleaning lip, represented in cross section, arranged thereon.

FIG. 2 shows a side view of a cleaning unit 16 having a support element 18 and a cleaning lip 14, represented in cross section, arranged thereon. The support element 18 includes a mounting strip 24 and, at each of its two ends, a retainer 25, which is bent with respect to the mounting strip 24. The cleaning unit 16 can be mounted in the textile machine by means of the retainers 25. The cleaning lip 14 is mounted on the mounting strip 24. The mounting strip has lateral faces 12 and end faces 13. The lateral faces 12 and at least one of the end faces 13 are provided for the form-locking mounting of the cleaning lip 14, 15.

Additionally to the lateral legs 22 represented in FIG. 1, the cleaning lip 14 according to FIG. 2 also includes webs 23, which connect the legs 22 to one another. The webs 23 protrude into recesses 26 of the mounting strip 24. The recesses 26 are open at the end face 13 of the mounting strip 24. Therefore, it is already ensured that the cleaning lip 14 cannot be displaced in the longitudinal direction on the mounting strip 24. In order to additionally obtain a good mounting perpendicular to the longitudinal direction of the mounting strip 24, a plurality of webs 23 and recesses 26 is provided, which are designed to be slanted with respect to the longitudinal direction of the cleaning unit 16.

According to the present exemplary embodiment, adjacent webs 23 and recesses 26 are directed toward each other in the shape of a V. The webs 23 and the recesses 26 each have, for example, an angle $\alpha$ of 80 degrees. With such an angle $\alpha$, on the one hand, a sufficient interlock of the cleaning lip 14 in the mounting strip 24 is ensured. On the other hand, however, it is also ensured, due to the elasticity of the cleaning lip 14, that the cleaning lip 14 can be pulled off the mounting strip 24 with a level of force that is higher than is to be expected during normal operation in the textile machine. The undercuts, which are formed by the angle $\alpha$, reliably hold the cleaning lip 14 on the mounting strip 24, without the need to use other mechanical clamping devices or force-locked connection means, such as adhesives.

The cleaning lip 14 represented in FIG. 2 also includes a horizontal groove 27 and a vertical groove 28. The horizontal groove 27 extends in the longitudinal direction of the cleaning lip 14 and ensures a slight folding of the stem 20 with respect to the legs 22 and the support element 18. It also ensures that the legs 22 of the cleaning lip 14 cannot be bent up to an excessive extent and, as a result, the retention of the cleaning lip 14 at the mounting strip 24 would be weakened.

The vertical groove 28 acts as a marking. If the cleaning lip 14 is to be used in a shorter length than the cleaning lip 15, for example, as a cleaning unit 17 for shorter top rollers 4,6, 8, or 10, it can be trimmed at this point of the vertical groove 28. These types of vertical grooves 28 can also mark the longer length of the cleaning lip 14 represented in FIG.

2. This is advantageous, in particular, for the case in which the cleaning lip 14, 15 is manufactured and distributed as yard goods and is to be trimmed to the necessary length, for example, at the machine itself.

Figure 3:
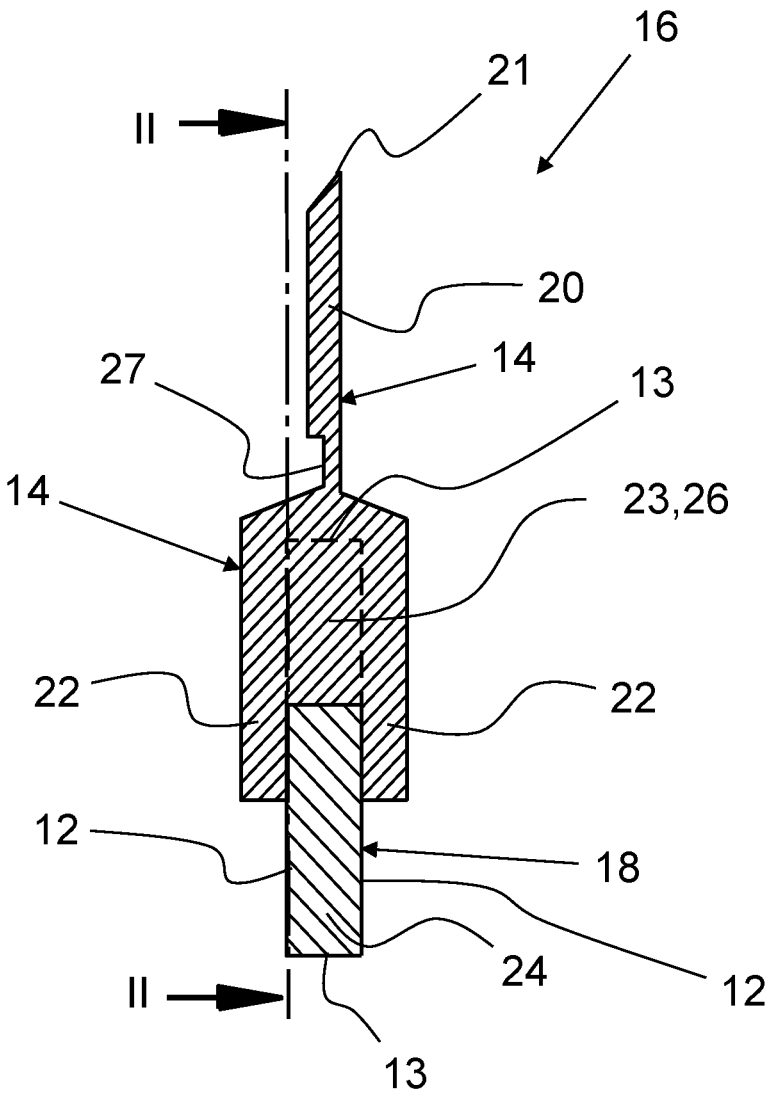
FIG. 3 shows a cross section of a cleaning unit.

FIG. 3 shows a cross section of the cleaning unit 16. Therein, the rectangular cross section of the mounting strip 24 with two lateral faces 12 and two end faces 13 is apparent. The mounting strip 24 is laterally encompassed by the two legs 22 of the cleaning lip 14. The two legs 22 are also connected to each other with the web 23. The web 23 is located in the recess 26 of the mounting strip 24. The horizontal groove 27 is arranged at the stem 20 of the cleaning lip 14, which weakens the stem 20, and so it can more easily fold. The wiping edge 21 is provided at the end of the stem 20 facing away from the two legs 22. In the representation from FIG. 3, the Y-shaped cross-sectional design of the cleaning lip 14, which is represented upside down here, is very clearly apparent.

Figure 4:
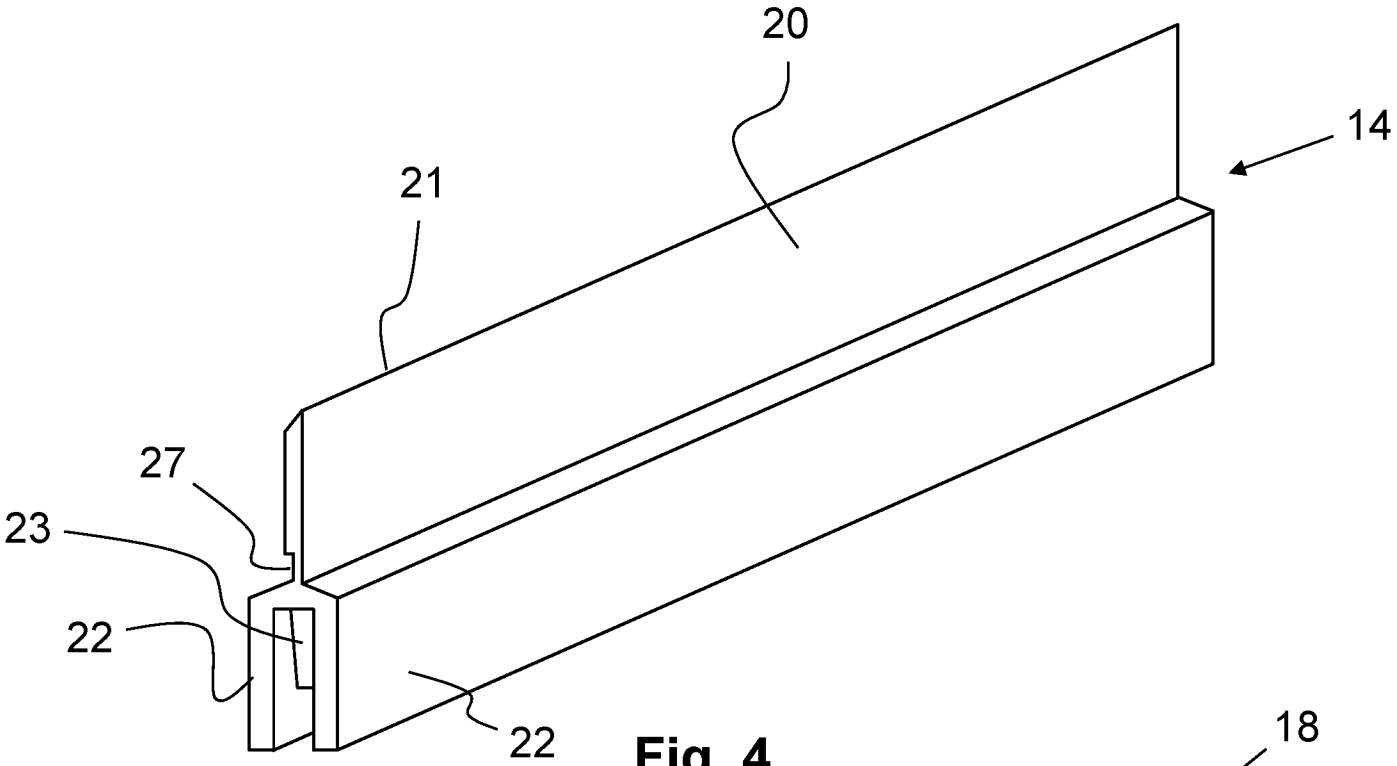
FIG. 4 shows a perspective representation of a cleaning lip.

FIG. 4 shows a perspective representation of a cleaning lip 14. The wiping edge 21 is arranged at one end of the stem 20. The horizontal groove 27 is located at the other end of the stem 20, at which the two legs 22 are arranged. The two legs 22 are partially connected to each other with a web 23, and so a sufficient dimensional stability of the two legs 22 is ensured and a bending-up of the legs 22 is largely avoided.

Figure 5:
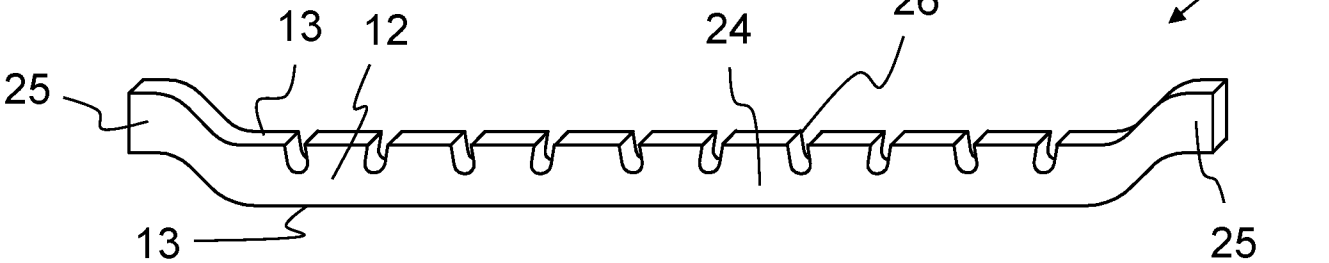
FIG. 5 shows a perspective representation of a support element.

While the cleaning lip 14 is made of an elastic material, for example, polyurethane or HNBR or silicone, the support element 18 according to the perspective representation from FIG. 5 is made of a rigid plastic or of metal. The support element 18 has the retainers 25 at its two ends. The mounting strip 24 is located between the two retainers. The slanted recesses 26 are apparent on the end face 13 of the mounting strip 24, which are slanted toward one another in pairs in the shape of a V. As a result, a fixed interlock is made possible between the support element 18 and a cleaning lip 14 situatable thereon. Due to the elasticity of the cleaning lip 14, however, the cleaning lip 14 is to be removed from the support element 18, preferably nondestructively, with an appropriate level of force and a new cleaning lip 14 can be inserted into the recesses 26. The support element 18 can therefore be reused with the new cleaning lip 14, even though the previous cleaning lip 14 is worn.

The present invention is not limited to the represented and described exemplary embodiments. Modifications within the scope of the claims are also possible, as is any combination of the features, even if they are represented and described in different exemplary embodiments.

LIST OF REFERENCE NUMBERS

1 drafting system
2 sliver
4 top roller
5 bottom roller
6 top roller
7 bottom roller
8 top roller
9 bottom roller
10 top deflection roller
11 running direction
12 lateral face
13 end face
14 cleaning lip
15 cleaning lip
16 cleaning unit
17 cleaning unit
18 support element
19 support element
20 stem
21 wiping edge
22 leg
23 web
24 mounting strip
25 retainer
26 recess
27 horizontal groove
28 vertical groove
$\alpha$ angle

The invention claimed is:

1. An elastic cleaning lip for cleaning a rotating roller of a drafting system of a textile machine, comprising:

a wiping edge configured at a longitudinal side of the cleaning lip;

a mounting element at an opposite longitudinal side of the cleaning lip configured to mount to a support element;

the cleaning lip configured into a Y-shaped structure comprising a stem and two essentially parallel legs that are laterally outward of the stem and the wiping edge, wherein the two legs are connected to each other with a plurality of webs, and wherein adjacent webs are slanted in a diametrically opposed manner with respect to one another;

wherein the wiping edge is arranged at an end of the stem and the two legs form the mounting element for a form-locking mounting of the cleaning lip to the support element;

wherein the cleaning lip including the wiping edge, the mounting element, and the plurality of webs is formed of a same material; and a groove defined along a longitudinal side of the stem at an end of the stem adjacent to the two legs, the groove defining a reduced thickness section of the stem laterally inward of the two legs.

2. The elastic cleaning lip according to claim 1, wherein each web of the plurality of webs, as viewed from an open end of the two legs, has at least one undercut.

3. The elastic cleaning lip according to claim 1, wherein each web of the plurality of webs is slanted with respect to the longitudinal side of the cleaning lip at an angle ($\alpha$) between 60° and 85°.

4. The elastic cleaning lip according to claim 1, comprising at least one additional groove disposed in the stem and extending transversely to a longitudinal direction of the stem.

5. The elastic cleaning lip according to claim 1, wherein the cleaning lip is formed from one of: polyurethane, hydrogenated nitrile butadiene rubber, or silicone.

6. The elastic cleaning lip according to claim 1, wherein the two legs extend along an entirety of the cleaning lip.

7. The elastic cleaning lip according to claim 1, wherein the groove extends along an entirety of the cleaning lip.

8. The elastic cleaning lip according to claim 1, wherein the same material comprises an elastic material.

9. A cleaning unit for cleaning a rotating roller of a drafting system of a textile machine, comprising:

the elastic cleaning lip according to claim 1;

a support element, the cleaning lip mountable onto the support element, the support element further comprising;

retainers at opposite longitudinal ends thereof;

a mounting strip having lateral faces and top and bottom end faces arranged between the retainers; and wherein the lateral faces and the top end face are configured for a form-locking mounting of the cleaning lip.

10. The cleaning unit according to claim 9, wherein the mounting strip comprises at least one recess in the top end face configured to accommodate the plurality of webs of the elastic cleaning lip.

11. The cleaning unit according to claim 10, wherein the at least one recess is slanted with respect to the top end face at an angle ($\alpha$) between 60° and 85°.

12. The cleaning unit according to claim 10, comprising a plurality of recesses, wherein adjacent recesses are slanted in a diametrically opposed manner with respect to one another.

13. The cleaning unit according to claim 9, wherein the support element is made of plastic or of metal.

* * * * *